US008096093B1

(12) United States Patent
Poon

(10) Patent No.: US 8,096,093 B1
(45) Date of Patent: Jan. 17, 2012

(54) GROUTLESS WALL TILE SYSTEMS

(76) Inventor: Pinky Yin Wah Poon, Hong Kong (HK)

( * ) Notice: Subject to any disclaimer, the term of this patent is extended or adjusted under 35 U.S.C. 154(b) by 0 days.

(21) Appl. No.: 13/180,571

(22) Filed: Jul. 12, 2011

Related U.S. Application Data

(60) Provisional application No. 61/379,410, filed on Sep. 2, 2010, provisional application No. 61/411,928, filed on Nov. 10, 1010, provisional application No. 61/449,604, filed on Mar. 4, 2011.

(51) Int. Cl.
*E04C 2/36* (2006.01)

(52) U.S. Cl. ..... 52/716.2; 52/311.1; 52/385; 52/390; 52/467; 52/612; D23/307; D25/138

(58) Field of Classification Search ..... 52/459, 52/461, 465, 467, 311.1, 311.2, 384, 385, 52/389, 390, 391, 409, 411, 416, 417, 419, 52/420, 460, 462, 506.1, 518, 554, 560, 561, 52/596, 604, 612, 716.1, 716.2, 836, 847, 52/746.1, 747.11, 747.12, 748.1; D23/307, D23/308; D25/138
See application file for complete search history.

(56) References Cited

U.S. PATENT DOCUMENTS

| | | | | |
|---|---|---|---|---|
| 1,625,637 | A * | 4/1927 | Abel | 52/467 |
| 2,412,693 | A | 12/1946 | Pierson | |
| 2,995,785 | A | 8/1961 | Driscoll | |
| 3,628,297 | A * | 12/1971 | Richardson | 52/267 |
| 3,963,846 | A | 6/1976 | Bourke | |
| 4,020,611 | A | 5/1977 | Amos | |
| 4,158,274 | A | 6/1979 | Saenz | |
| 4,452,022 | A | 6/1984 | Bezborodko | |
| 4,825,618 | A | 5/1989 | Blevins | |
| 5,274,982 | A | 1/1994 | Price | |
| 5,311,717 | A | 5/1994 | Yount et al. | |
| 5,375,385 | A | 12/1994 | Feder | |

(Continued)

FOREIGN PATENT DOCUMENTS

CN 201144498 Y 11/2008

(Continued)

OTHER PUBLICATIONS

Tile Backsplash Ideas by Supreme Surface Inc. (http://www.supremesurface.com/backsplash/Tlle_Backsplash.html) Retrieved Sep. 9, 2011 PDF Screen Capture.

(Continued)

*Primary Examiner* — William Gilbert
(74) *Attorney, Agent, or Firm* — Ella Cheong Hong Kong; Margaret Burke; Sam Yip

(57) ABSTRACT

An easily-installed groutless wall tile plank backsplash system includes plural lower tile planks positioned edgewise spaced from each other in a horizontal direction of a wall in a lower plane. Plural upper tile planks have a decorative surface and edge finish, optionally three-dimensional, and are positioned edgewise spaced apart from each other in a second, upper plane. The lower and upper planks are configured such that facing inner edges of two nearest neighbor adjacent lower planks in the lower plane are covered by a single upper plank positioned over the inner edges of the adjacent lower planks in the upper plane. The planks are secured by an adhesive without mechanical fasteners, substantially reducing installation time. In order to custom fit a wall space, the spacing between adjacent upper planks and adjacent lower planks is variable. For emphasis, a lower tile plank can be a large decorative mural tile plank.

19 Claims, 19 Drawing Sheets

U.S. PATENT DOCUMENTS

| | | | | |
|---|---|---|---|---|
| 5,487,250 | A | 1/1996 | Yount et al. | |
| 5,502,940 | A | 4/1996 | Fifield | |
| 5,581,957 | A | 12/1996 | Egger | |
| 5,590,500 | A | 1/1997 | McCue | |
| 5,891,282 | A | 4/1999 | Stough et al. | |
| 6,308,485 | B1 | 10/2001 | Blumenthal | |
| 6,330,774 | B1 | 12/2001 | Weinstein | |
| 6,363,677 | B1 | 4/2002 | Chen et al. | |
| 6,367,218 | B2 | 4/2002 | Lombardo | |
| D474,055 | S | 5/2003 | Brewster | |
| D635,279 | S | 3/2011 | Mathon | |
| D639,461 | S | 6/2011 | Martin et al. | |
| 2003/0051426 | A1* | 3/2003 | Kornfalt | 52/396.1 |
| 2003/0115813 | A1 | 6/2003 | Wong Hahn | |
| 2004/0093819 | A1 | 5/2004 | Ritzer | |
| 2004/0226230 | A1 | 11/2004 | Ritzer | |
| 2005/0246989 | A1 | 11/2005 | Pringle et al. | |
| 2005/0257436 | A1 | 11/2005 | Vanderpol | |
| 2005/0262788 | A1 | 12/2005 | Fernandes | |
| 2006/0080910 | A1 | 4/2006 | Cornia | |
| 2006/0174556 | A1* | 8/2006 | Kornfalt et al. | 52/181 |
| 2006/0179791 | A1 | 8/2006 | Shaw | |
| 2006/0179792 | A1 | 8/2006 | Shaw | |
| 2007/0245662 | A1* | 10/2007 | Stanchfield | 52/459 |
| 2008/0313981 | A1* | 12/2008 | Donley et al. | 52/203 |
| 2009/0108719 | A1 | 4/2009 | Lilly | |
| 2009/0282756 | A1 | 11/2009 | Begur et al. | |
| 2009/0320403 | A1 | 12/2009 | Love | |
| 2010/0115865 | A1 | 5/2010 | Donnelly et al. | |
| 2010/0223872 | A1 | 9/2010 | Taylor et al. | |
| 2010/0251655 | A1 | 10/2010 | Monteer | |
| 2011/0023398 | A1 | 2/2011 | Ismay et al. | |
| 2011/0094173 | A1 | 4/2011 | Parker et al. | |

FOREIGN PATENT DOCUMENTS

| | | |
|---|---|---|
| CN | 201400974 Y | 2/2010 |
| JP | 06-129072 | 5/1994 |
| JP | 11-117503 | 4/1999 |

OTHER PUBLICATIONS

Tile by Design (url: http://www.tilebydesign.net/mosalcs.htm)Retrieved Sep. 9, 2011 PDF Screen Capture.
Internet screen shots of tile images, 2011.

* cited by examiner

GROUTLESS WALL TILE SYSTEMS

RELATED APPLICATIONS

The present application claims the benefit of U.S. Provisional Applications 61/379,410 and 61/411,928, and 61/449,604 the disclosures of which are hereby incorporated by reference.

TECHNICAL FIELD

The present invention relates to wall tile systems in general and, more particularly, to easy-to-install tile plank systems for groutless tile backsplashes.

BACKGROUND

Tiles have long been used as surface coverings. They are used in different environments to provide different functions, for example to provide hard wearing surfaces, decorative surfaces or water proof surfaces. The size, shape, material and surface finishing of each tile installed in a tiling array can all be varied according to the use requirements. A tiling array as defined herein is an arrangement of tiles in various shapes, sizes and materials that are assembled to continuously cover a surface.

Tiles are frequently used to provide water resistant coverings for walls, such as backsplashes near sinks and work surfaces in kitchens and bathrooms. One application covers a wall in a tiling array composed of the same general type of tile with characteristics such as color or size varied to produce decorative patterns. The expression "water resistant," as used herein, means an assembly, such as a backsplash, that can withstand repeated intermittent contact with liquids such as water without substantial degradation of the backsplash materials or overall backsplash system. The expression "backsplash" as used with reference to the present invention, relates to an installed tile system having a configuration as described below that is water resistant as defined above.

Conventionally tile installation is a skilled, labor-intensive procedure. Each tile must be individually affixed in a precise pattern having identical spacing between tiles (tile spacers are often used to assist in maintaining the correct spacing). First the tiles must be affixed to the surface using some kind of affixing agent such as "thin set," mortar, mastic, etc. Traditional tiles have dimensional variance of on the order of 1-3 mm thus maintaining identical spacing between tiles while maintaining proper tile alignment is extremely difficult. Further, to cover any intended space and maintain the proper tile spacing, numerous tiles must be cut in order to "fit" onto a wall or floor. Cutting tiles is both time-consuming and imprecise- even when specialized tools are used, tiles often crack during the cutting process and must be discarded.

The spaces between tiles are manually filled with a material called grout, which hardens after application. The grout composition is varied according to the required use, including providing water proofing to prevent water permeation and flexibility to accommodate thermal expansion. Applying grout is a time-consuming, labor-intensive, and messy process; when performed by do-it-yourself ("DIY") homeowners or others unskilled in tilework, the resulting grout surface appearance is often unattractive. Because grout hardens and is generally inflexible, it is not uncommon for cracks and chips to form as different pressures are exerted on the finished tiles. Further, grout discolors over time, holds stains, and is often difficult to clean.

To install grout-based tile systems, skilled installers are required. Installation is typically at least a two-day process. On the first day, the tiles are affixed to the surface; on the second day, spaces between the tiles are filled with grout.

Accordingly, there is a need to create grout-free tile-based wall coverings that can be easily installed by unskilled people, without the need to precisely align the tiles in an inflexible spacing pattern and with a minimum need to trim tiles.

Several approaches to wall covering systems are described in the prior art. In US Pat. Pub. No. 2009/0108719, a specially designed clip aligns and affixes backsplash panels to countertops. To place the clip, a slot must be cut onto the rear edge of the countertop in a direction that is substantially parallel to a plane defined by the countertop surface; a corresponding slot must be cut into the bottom edge of the backsplash panel. The clip extends into the two slots to attach the countertop and backsplash.

U.S. Pat. No. 3,628,297 describes an installation system for refacing an existing wall. The system includes vertically elongated panels extending between the floor and ceiling boundaries of an existing wall, secured by concealed fasteners. The '297 system requires installation of ground and floor channels for securing the top and bottom of the wall panels. The front and rear panels are attached to each other by fastening clips partially attached to the panels while the rear panels are affixed to the wall by screws. Because the clips are partially embedded in the panels, the spacing is not adjustable; therefore panels with various dimensions must be provided to fit a predetermined width of the wall. Measuring panel size and spacing makes the preparation and installation process more complicated. Moreover, the resultant surface is not water resistant.

U.S. Pat. No. 4,825,618 describes an overlapping tile having a lip and a flange for engaging an adjacent tile, where the lip and flange abut in a way that interlocks one tile with another on the same plane. Because the lip and flange of the tile must be abutted, the spacing of the tiles is not adjustable and thus cannot custom fit a space without being cut. Further, such lips and flanges are extremely difficult to manufacture with the required precise tolerances required for interlocking.

U.S. Pat. No. 4,452,022 relates to a mirrored wall system in which framed mirrored panels are mechanically anchored to the wall while mirrored strips adhesively cover the joint between adjacent mirror panels. The frame of the mirror panels allows the panels to be aligned and secured to the wall by a fastener arrangement including a metal strap and a mechanical fastener. However, mechanical fasteners are typically unsuitable for use with many tile materials and are further unsuitable in installations where there will be frequent intermittent contact with water/liquids such as a backsplash installation.

Thus there is a need in the art for improved backsplash systems and backsplash tiles that can flexibly cover a variety of surface dimensions with simple, grout-free installation. Such tiles and systems could be quickly and easily installed by non-professional tile installers, such as cabinet installers and DIY homeowners. Such a system could be used to substantially decrease the time of kitchen installations to around one day while a single installer can erect the backsplash and countertops in as little as a few hours.

SUMMARY OF THE INVENTION

The present invention provides improved backsplash tile systems that enhance the overall aesthetic appeal of a surface. The tiles and systems of the present invention can be simply installed; facilitating application by unskilled workers, including DIY homeowners, with substantially reduced cost, time and level of skill required. The present system does not require tile cutting or grouting and can flexibly fit various dimensions.

The groutless tile plank backsplash system includes plural monolithic lower tile planks which can be made from a material including natural stone, marble, granite, porcelain, artificial stone, concrete, ceramic, glass block, or slumped glass. The term "monolithic," relates to a relatively large, single, substantially uniform whole tile plank without mechanical fastening elements or elements configured to receive mechanical fastening elements. Although in some embodiments, optional reinforcing backing members are added, these are to prevent tile breakage during transport, installation, and backsplash use; the tile member itself is still a monolithic tile. The lower tile planks have a first decorative surface finish and thickness and can have the same or different widths. One or more tile planks can comprise a large decorative element such as a mural or mosaic to create an aesthetic focal point for the system. The term "mural" as used herein, is used broadly to denote a large focal tile with a decorative feature/artwork element which can be any kind of decorative feature formed by etching, inlay work, painting, glazing, or surface relief feature (a sculpture-like effect in relief giving the impression that the a figure or design is raised above the background), etc. Other three-dimensional features can be formed in slumped glass, molded concrete or fiber-reinforced concrete, molded ceramic/porcelain, pressed metal, pressed ceramics, etc.

The edges of the mural lower planks are the same thickness as the remaining lower planks but the decorative central portion of the plank may have a three-dimensional patterned formed thereon and thus portions of the mural plank may be thicker or thinner than the remaining lower tile planks. Each lower plank is positioned edgewise spaced from each other in a horizontal direction of the wall in a first, lower plane. The lower planks are further manufactured to have a length extending vertically between selected predetermined upper and lower boundaries of the wall to minimize the need for cutting the tile plank.

Plural upper tile planks are made from a second material, which is the same or different from the first material. The second material is monolithic, rigid natural stone, marble, granite, porcelain, artificial stone, concrete, ceramic, or slumped glass. The term "rigid," as used herein, relates to a material that is sufficiently stiff such that it can support its own weight when held by one edge. It means that the material is substantially inflexible and not bendable. The upper tile planks have a decorative surface finish, which may be three-dimensional, and a decorative vertical edge finish on one or more exposed vertical edges. Each upper plank is positioned edgewise spaced apart from each other in the horizontal direction of the wall in a second, upper plane. As with the lower tile planks, the upper tile planks are manufactured in a predetermined length to minimize the need to cut the plank. The width of each upper plank can be variable (that is, all upper planks need not be the same width) and the upper plank thickness can be the same as or different from the lower plank thickness.

The lower and upper planks are configured such that at least facing inner edges of two nearest neighbor adjacent lower planks in the lower plane are covered by a single upper plank positioned over the inner edges of the adjacent lower planks in the upper plane. The planks are secured in position by an adhesive without the need for mechanical fasteners, or other mechanical installations to hold the tile planks, substantially reducing installation time. In order to custom fit a wall space, the spacing between adjacent upper planks and adjacent lower planks is variable and the spacing between upper planks is the same or different from the spacing between lower planks.

BRIEF DESCRIPTION OF DRAWINGS

Embodiments of the invention are described in more detail hereinafter with reference to the drawings, in which.

DETAILED DESCRIPTION

Turning to the drawings in detail, the following description sets forth a tile plank installation system for wall covering in the form of various exemplary embodiments. It will be apparent to those skilled in the art that modifications, including additions and/or substitutions may be made without departing from the scope and spirit of the invention. Specific details may be broadly described so as not to obscure the features of the invention; however, the disclosure is written to enable one skilled in the art to practice the teachings herein without undue experimentation.

Figure 1:
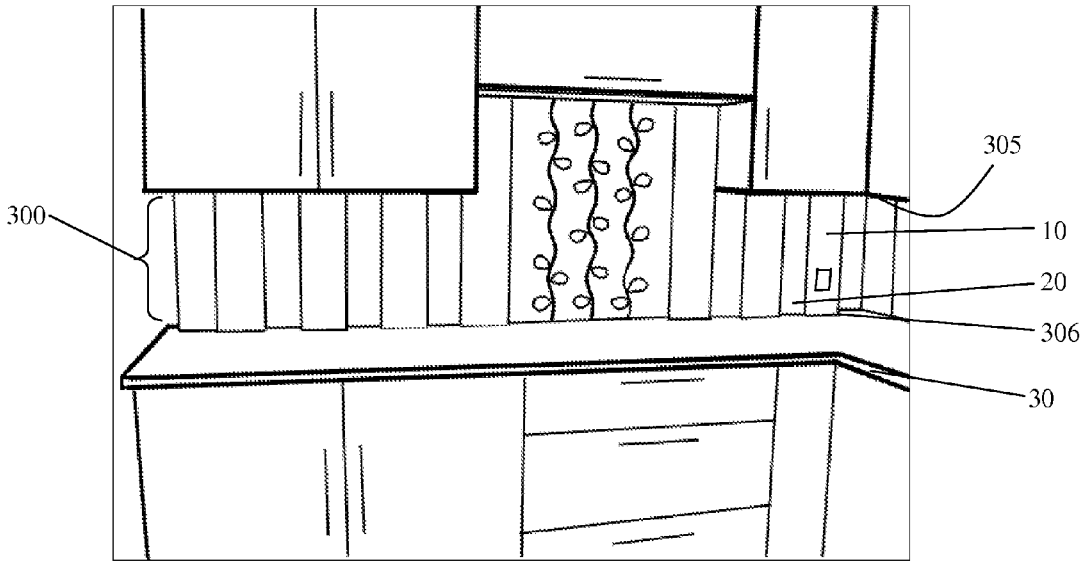
FIG. 1 is a photograph depicting a tile backsplash system according to the present invention

FIG. 1 depicts a photograph of a groutless tile plank backsplash system according to an embodiment of the present invention. In this view, upper tile planks 10 and lower tile planks 20 are formed in standardized sizes for accommodating a space between a countertop 30 positioned at lower boundary 306, and either the ceiling or a base of wall cabinets, shown as upper boundary 305. The tile plank system is used as a backsplash 300 for a kitchen or bathroom. As used herein, the term "backsplash" is broadly used to mean an array of tiles that has some degree of water resistance. Although such backsplashes are typically positioned behind a sink and between a counter and cabinets or a ceiling, the invention is not limited to such locations. The groutless tile plank backsplash system can be placed on a variety of vertical surfaces including, but not limited to, kitchen walls, bathroom walls (either behind a sink or as a surface extending upward from a floor), kitchen island outer surfaces, entrance walls, basements, laundry areas, etc. The system of the present application is also applicable to a variety of commercial buildings including restaurants, hotels, office buildings and other commercial environments where a water-resistant and easy-to-install tile surface is desirable. Particular examples include fast-food order counter walls, elevator lobbies, hotel reception desks and surrounding areas, etc. The system of the present invention is easy to clean and disinfect in comparison with conventional paint/wallpaper wall coverings, making it an ideal choice in heavily-trafficked commercial areas. Further, there are substantial cost and time savings associated with the easy-to-install system of the present invention on large commercial vertical surfaces.

Because the degree of overlap between the upper and lower tile planks is variable and the spacing between adjacent lower and or adjacent upper tile planks is variable, the backsplash system can be configured to cover a wide range of wall spaces. As seen in FIG. 1, various widths of lower tile planks 20 are exposed by the selected positions of upper tile planks 10 to custom fit the wall space available. Adhesive material is used to affix the tile planks to the wall surface and/or other tile planks.

Figure 2A:
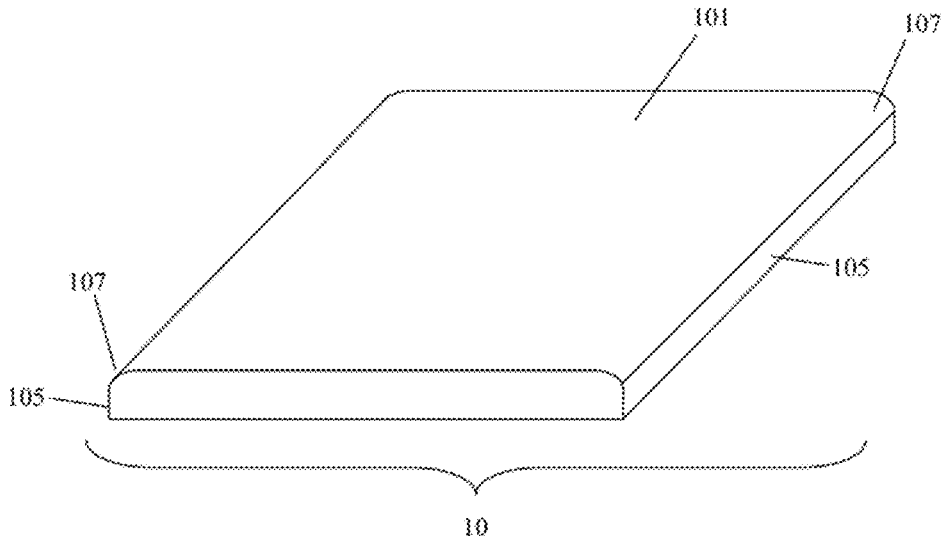
FIGS. 2A-2C show different views of an upper tile plank according to the invention with FIG. 2C depicting various cross-sectional views.

FIG. 2A shows a perspective view of an upper tile plank 10 with a decorative surface 101 and decorative vertical edges 105. Conventional tiles do not include edge finishing/decoration, such as polishing, since the edges of tiles are not exposed in a conventional grouted tile array. In an exemplary embodiment, the upper facing portion of each vertical edge may be micro-chamfered to provide a smooth edge finish 107 along with edge polishing so that the upper tile planks have a decorative surface finish on the top and at least the vertical edges (and optionally the upper and lower edges if they will be visible. Further, the thickness of the tiles as well as a level rear surface are provided (detailed embodiments for rear surfaces are discussed below). In conventional tile systems set in a tile base material, uneven tiles can be compensated for by the thickness of the tile mastic/thin-set base material. The bottom of the upper plank 10 contains an optional peripheral sealing strip, not shown.

Figure 2B:
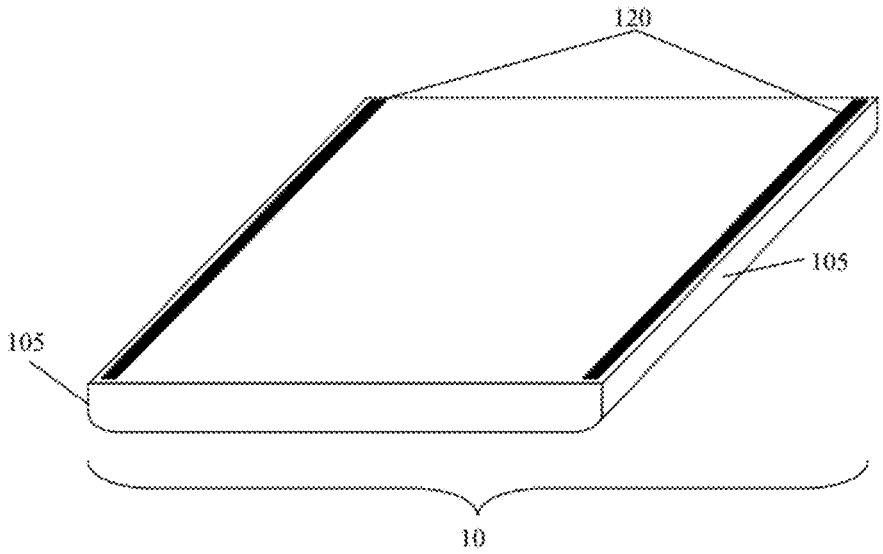

FIG. 2B depicts the underside of the upper plank 10 of FIG. 2A, where the plank includes optional sealing strips 120 such as compressible rubber or building putty material, or foam strips adjacent the peripheral vertical edges of the upper plank 10. In one example, the sealing strips are placed approximately 1 cm/0.4 inch from the decorative vertical edges 105.

Figure 2C:
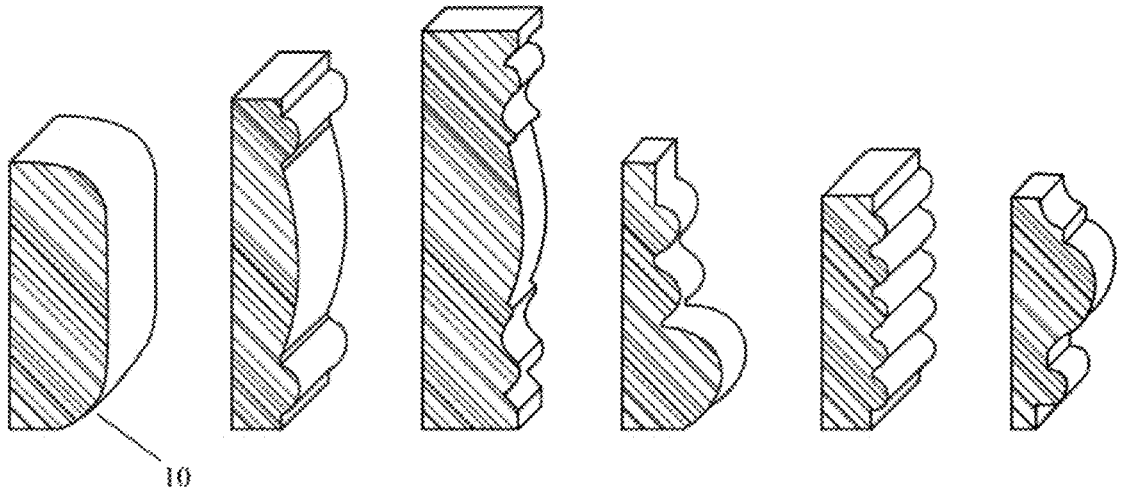

Although as seen in FIG. 1, the upper surface of upper plank 10 can be planar, a three-dimensional decorative surface feature can optionally be formed in the tile plank. FIG. 2C depicts exemplary three-dimensional decorative surface features than can be formed in the upper tile planks 10.

Figure 3:
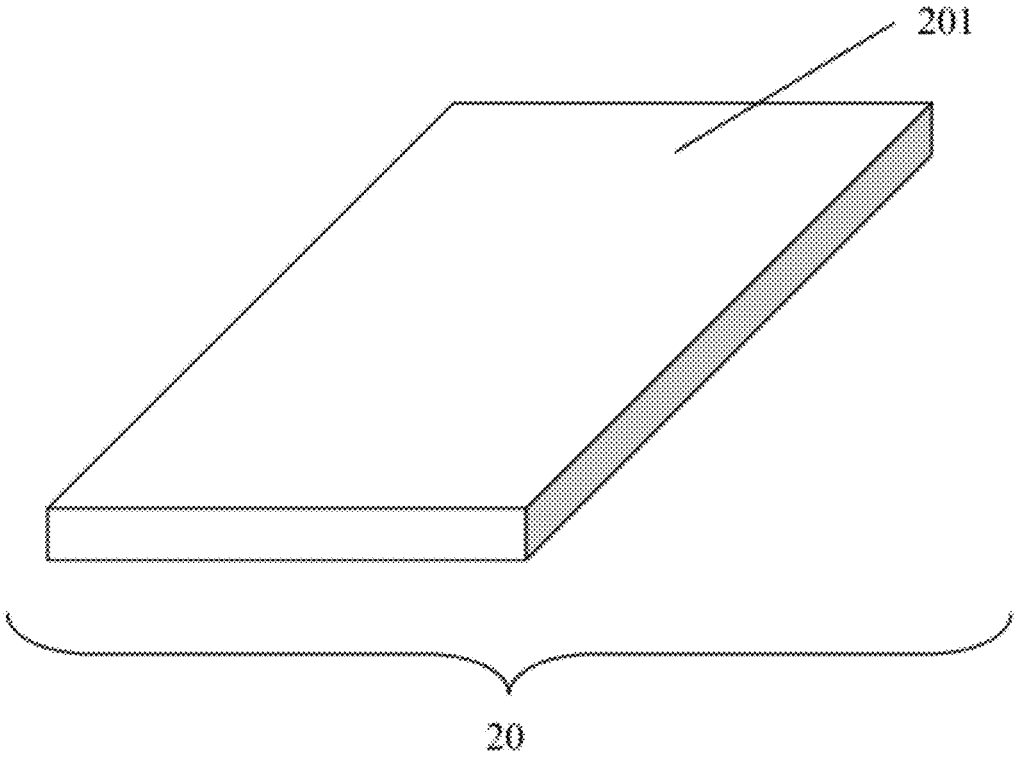
FIG. 3 depicts a lower tile plank.

FIG. 3 shows a perspective view of a lower plank 20 with a finished/decorative surface 201 and a similar or complementary pattern or color scheme as decorative surface 101. To reduce the stock keeping units (SKU) for retailers, it is possible to use upper planks 10 in lieu of lower planks 20 for the tile plank system. That is, tiles planks that include finished/decorative edges (as with planks 10) can be used even though those edges will be covered by the upper tile planks.

Upper tile planks 10 and lower tile planks 20 optionally have the same thickness. However, the thickness of the upper tile planks 10 can be different from the thickness of the lower planks 20 as long as all of the tile planks in a set of lower planks have substantially the same thickness, at least at the overlapping edge portions.

Lower tile plank 20 is manufactured from materials such as natural stone, marble, granite, porcelain, artificial stone, concrete, ceramic, or slumped glass. However, this list is not exhaustive and other materials may also be selected. Upper tile plank 10 is selected from materials including natural stone, marble, granite, porcelain, artificial stone, concrete, ceramic, or slumped glass. The upper and lower tile planks do not need to be made from the same materials; instead, upper and lower tile planks of different materials and surface finishes may be selected to produce any desired decorative aesthetic effect. The decorative surfaces 101 and 201, as well as edges 105 may be achieved by polishing, etching or glazing the tile planks, depending upon the selected materials. The three-dimensional surface of tile 10 shown in FIG. 2C may be achieved through machining or molding of the material during manufacture.

Figure 6A:
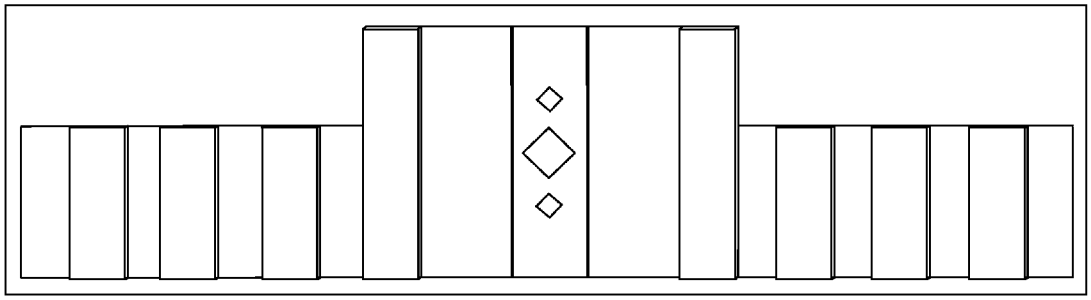
FIGS. 6A-6B are schematic illustrations of tile plank installations with tile planks of various widths including mural tiles.
Figure 6B:
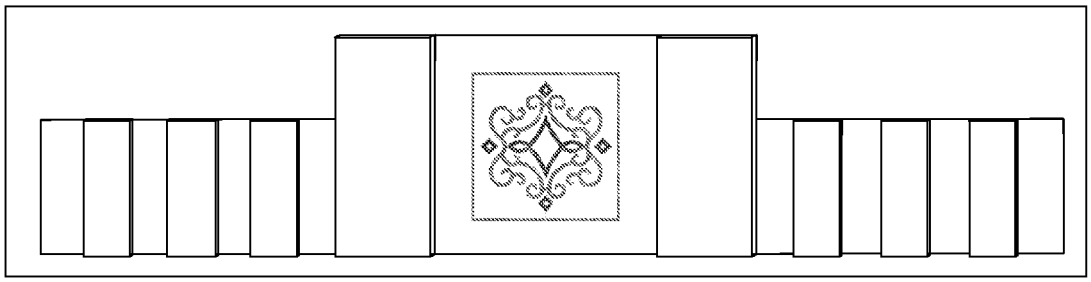

Optionally, plural widths of the upper and/or lower tile planks may be provided in the tile plank system of the present invention. Such a feature provides additional tile system flexibility to provide an aesthetically pleasing configuration for a variety of spaces. A mixed-width tile plank system is depicted in FIG. 6A. In one embodiment, a large decorative tile, such as a mural tile, can be selected as one of the mixed-width upper or lower tile planks to produce a dramatic focal point of the tile system as seen in FIG. 6B. When a lower tile plank is used as the mural tile plank, the edges of the mural lower planks are substantially the same thickness as the remaining lower planks but the decorative central portion of the plank may have a three-dimensional patterned formed thereon and thus portions of the mural plank may be thicker or thinner than the remaining lower tile planks. The mural tile plank can be made of various materials to create the decorative effect and can be a composite- e.g., a mosaic mounted on a backing material to create a lower tile plank.

Figure 7A:
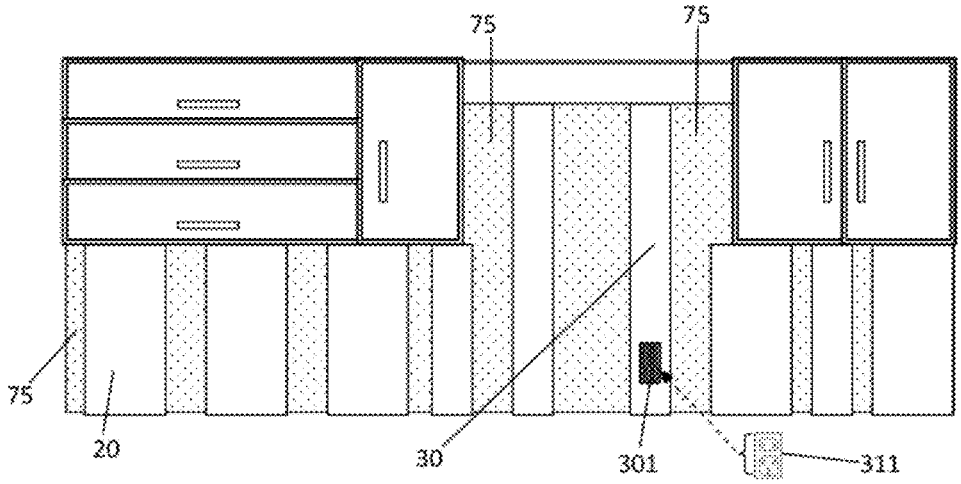
FIGS. 7A and 7B depict tile installations with electrical socket tile planks
Figure 7B:
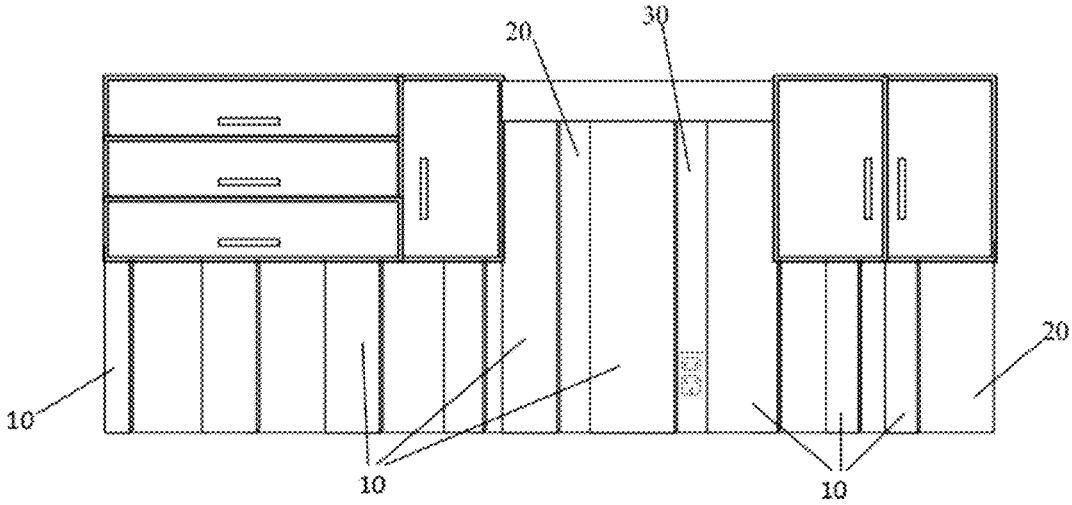

FIGS. 7A and 7B depict various configurations of upper and lower tile planks forming backsplashes. These FIGS. depict examples of tile plank layouts and optional tile plank features. For example, if there is a switch or an electrical socket box pre-installed on the wall, a tile plank includes an optional pre-cut fitting hole to correspond to the socket. As a result, it is not necessary for an installation worker to cut a hole in the tile plank to accommodate the switch or electrical socket. Both upper and lower tile planks can optionally include pre-cut holes for the switch/socket.

Tile planks having socket holes are optionally provided with extra length (that is, longer than other upper or lower tile planks) to allow vertical positioning of the pre-cut hole to correspond to the switch or electrical socket location. The extra length of the socket plank is trimmed to fit the upper and lower boundaries of the wall surface. In FIG. 7A, socket plank 30 (a lower plank) with a pre-cut socket hole 301 corresponding to the position of socket 311 is depicted. The wall is shown as element 75 and other lower tile planks 20 are also installed. As shown in FIG. 7B, upper planks 10 are then installed over socket plank 30.

Figure 8A:
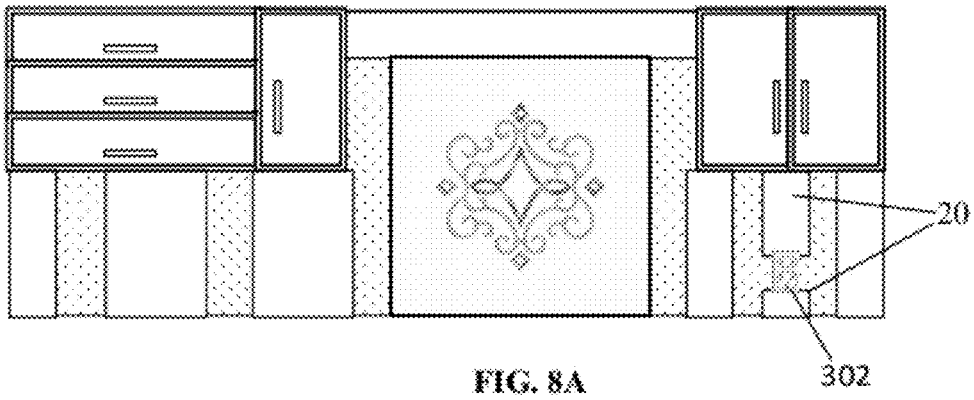
FIGS. 8A and 8B depict alternative tile installations with electrical sockets and mural tiles.
Figure 8B:
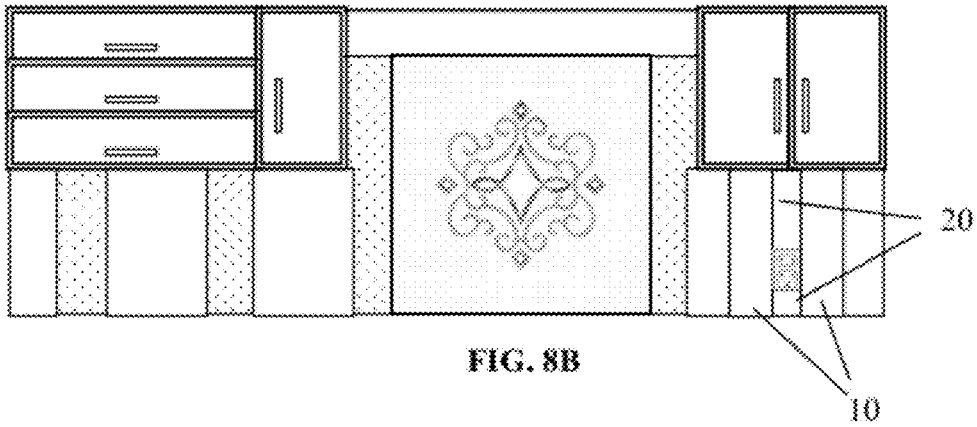

In an alternative embodiment, an electrical socket/switch is accommodated by cutting a tile plank to fit above and below the socket/switch. As seen in FIGS. 8A-8B which is an installation including a mural tile, socket 302 is abutted on above and below by a cut lower plank 20. Adjacent upper planks 10 are positioned to abut the edge of the electrical socket/switch 302. This system eliminates the need to provide tile planks with pre-cut socket holes, further saving the number of SKUs (since electrical switches and sockets come in a wide range of sizes) in the tile system of the invention.

Figure 9A:
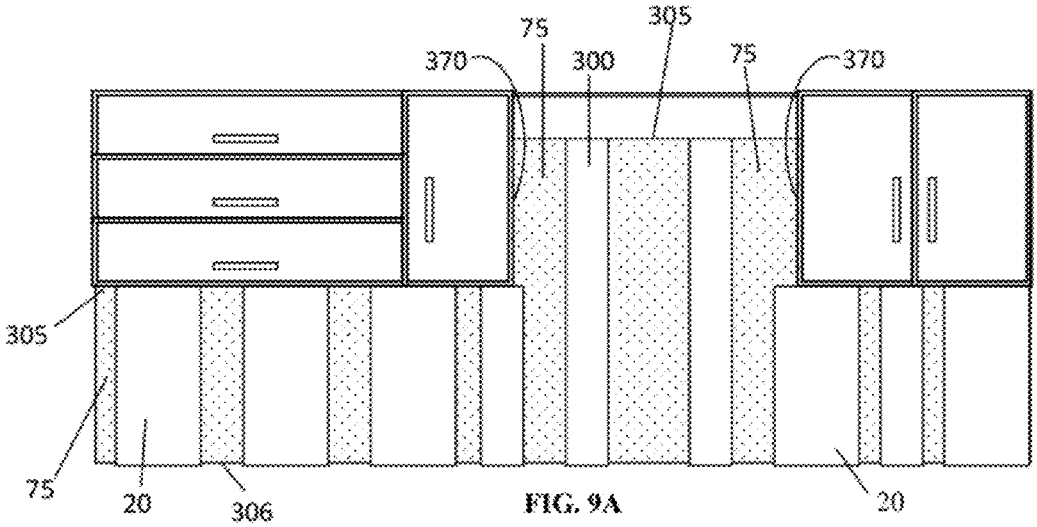
FIGS. 9A-9C describe an installation of the tile system.
Figure 9B:
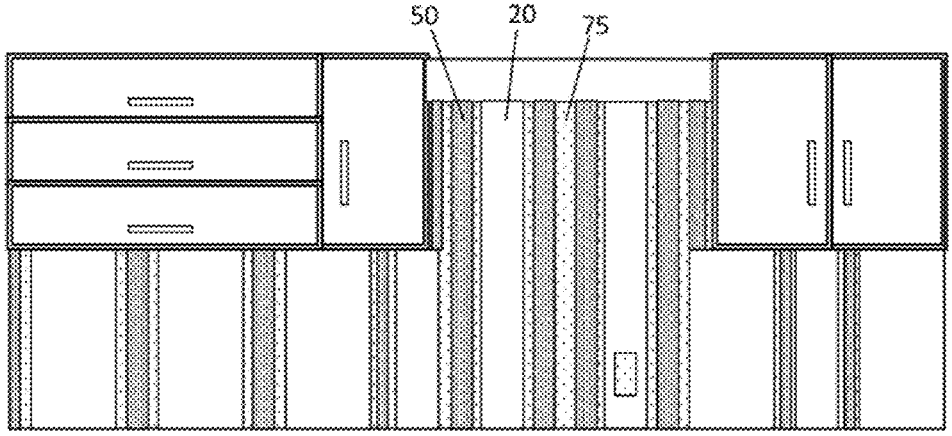

Installation of the tile plank system is now described with reference to FIGS. 9A-9C. As shown in FIG. 9A, lower planks 10 are positioned along sections of wall 75 adjacent to cabinet edges 370. The lower tile planks are adhesively affixed to the wall 75. As seen in FIG. 9A, the spacing of lower tile planks 10 can be flexibly arranged to accommodate the spacing between the cabinets and need not be the same as the spacing of tile planks that are positioned beneath the cabinets. Further, as seen in FIG. 9A, a variety of lower plank widths are selected to produce a desired aesthetic affect. As seen in FIG. 9B, optional support members 50 may be positioned between lower tile planks 10.

Figure 4A:
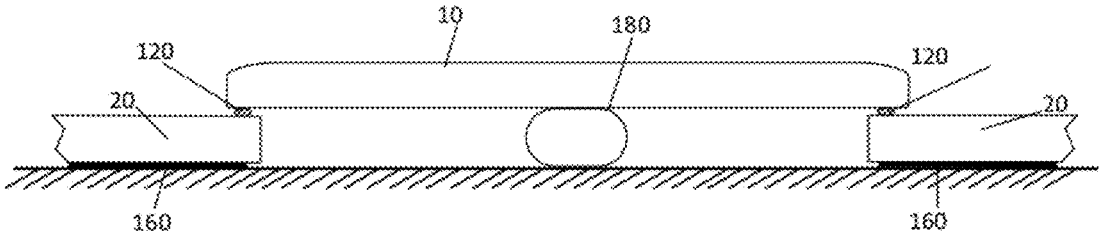
FIGS. 4A-4D depict various optional installations of an upper plank covering two nearest neighbor lower planks, with and without support members.
Figure 9C:
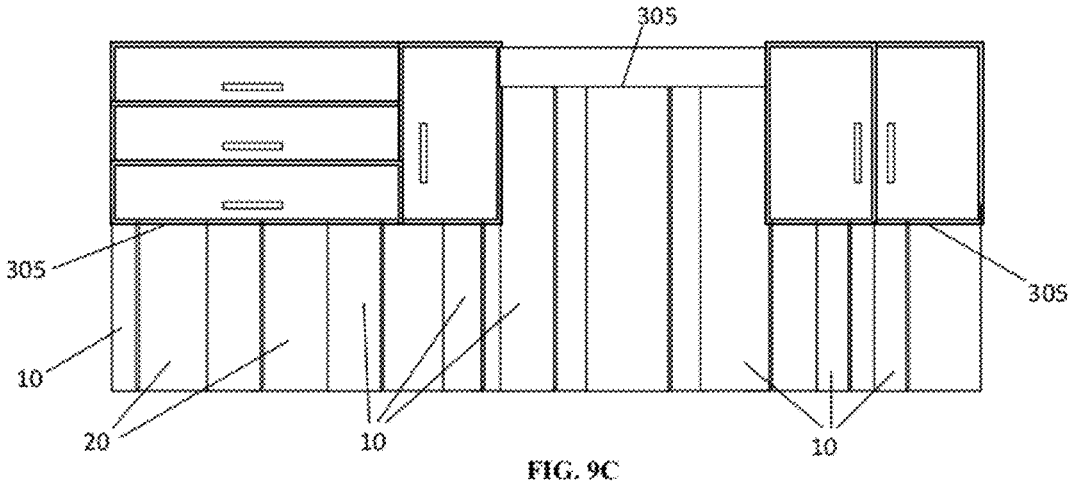

Whether or not support members are used, upper tile planks 20 are installed in FIG. 9C. When support members are not used, large spots of adhesive/caulk can optionally be used to provide support as depicted in FIG. 4A. However, for many installations, it is sufficient to adhere the upper tile planks to the lower tile planks (depending upon the size of the upper tile planks and the spacing of the lower planks). Caulking may be optionally applied along the upper boundary 305 and lower boundary 306 typically on the back of the tile planks as they are installed rather than following positioning. The upper planks 10 completely cover the optional support planks as well as the edges of two nearest neighbor adjacent lower planks 20, as seen in FIGS. 9B and 9C.

Figure 10A:
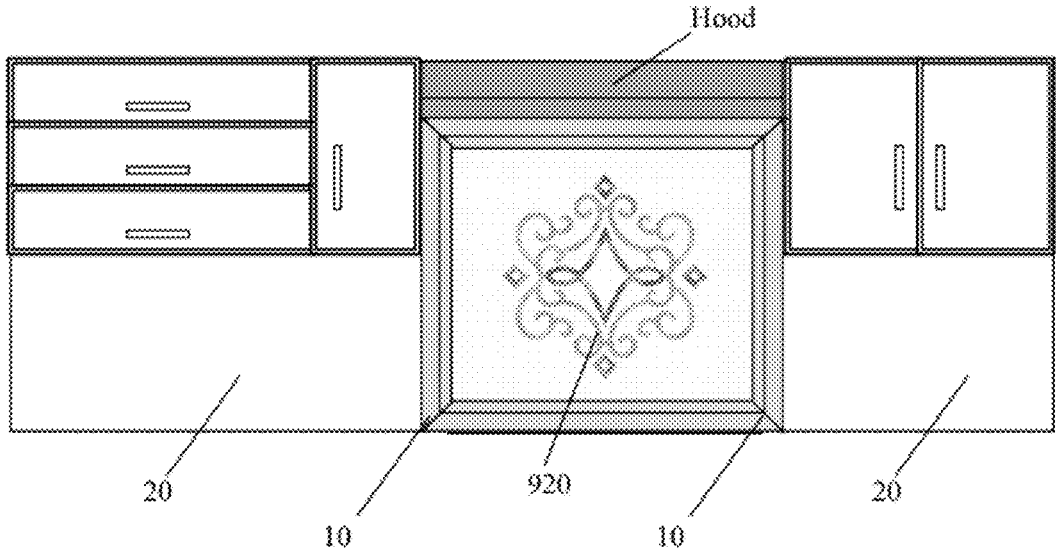
FIGS. 10A-10F depict tile mural tile installations including optional trim tiles surrounding the mural tile.
Figure 10B:
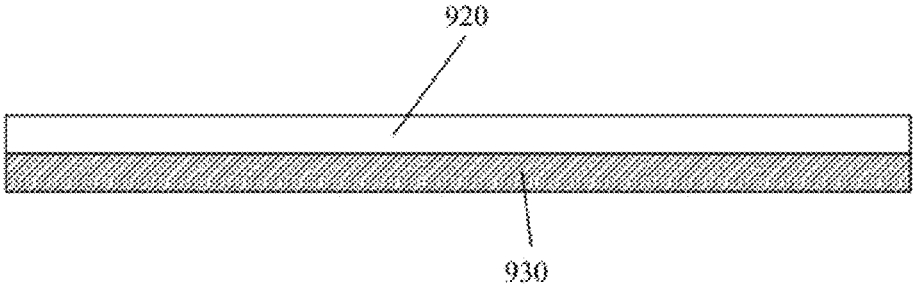

In another embodiment depicted in FIGS. 10A-10F incorporating a decorative mural tile 920, three-dimensional upper tiles 10 as depicted in FIG. 2C are used to decoratively frame the mural tile 920. In the example of FIG. 10, the mural installation is above a cooktop or range; consequently an optional range hood for ventilation is depicted. However, it is understood that the mural tile or tiles can be positioned at any wall position where an emphatic decorative effect is desired. The mural tiles 920 have typical sizes on the order of 30 inches×30 inches to cover wall dimensions behind a cook area or sink. The patterns of the mural can be made by water jet with inlay of the same or different materials. Alternatively, composite tile mosaics and other decorative murals can be used. Mural tile 920 can be a unitary tile material or, alternatively, can include a reinforcing backing laminated thereto such as those described below or various honeycomb structures or other sturdy reinforcing backing structures 930 as schematically depicted in FIG. 10B. Further, a low cost strong ceramic, such as porcelain or stone material could also be used. Any material that can be easily laminated to the mural tile and provide support can be used as the reinforcing backing. Because the mural tile 920 is both larger and more expensive than other tile planks, tile strengthening and support is desirable as larger tiles are easier to break.

Figure 10C:
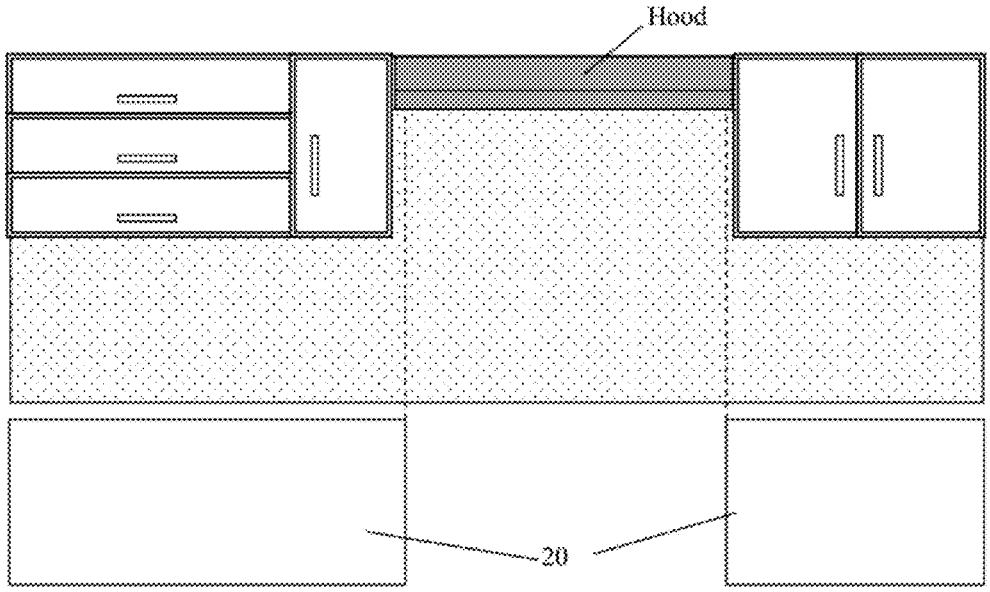
Figure 10D:
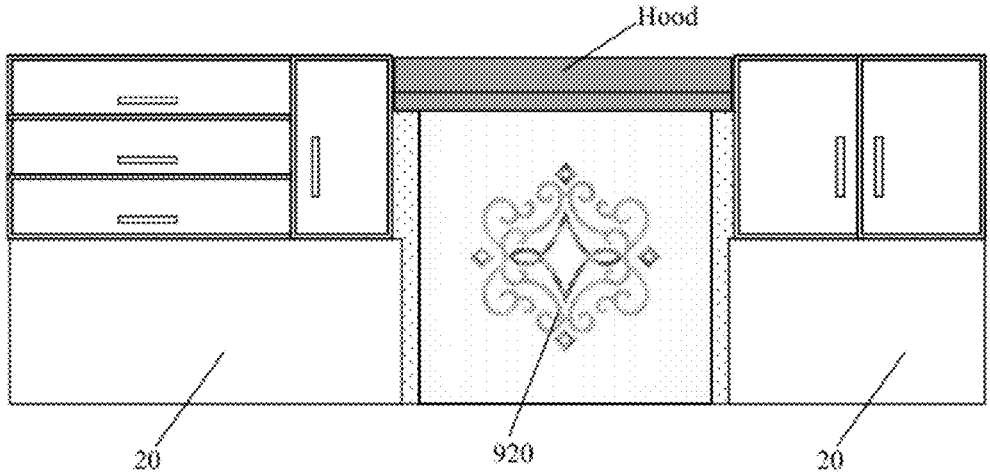

During installation, mural tile 920 typically functions as a low tile plank 29 as seen in FIGS. 10C and 10D in which low tile planks 20 and mural tile 920 are sequentially installed. Since the edges of the low tiles are covered, any support lamination will not be seen.

Figure 10E:
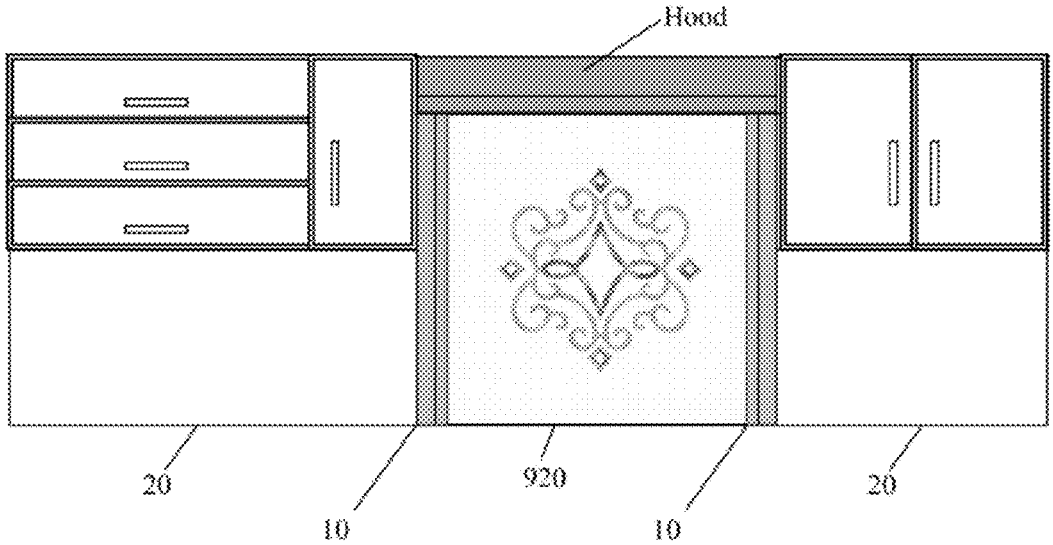
Figure 10F:
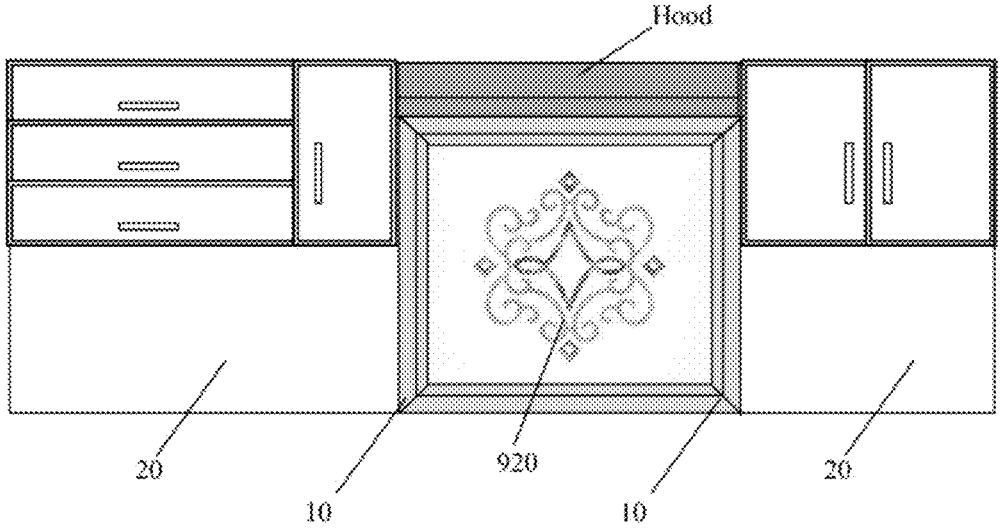

As seen in FIGS. 10E and 10F, three-dimensional high tiles 10 as seen in FIG. 2C are positioned around mural tile 920 to frame the tile for further emphatic effect.

An important feature of the present invention is that it is typically not necessary to custom cut the tiles to fit the boundaries of the backsplash or to provide uniform spacing between each plank for grouting. This is particular true for the edges of the tiles because of the highly variable spacing in the width direction of the installation. Because the upper planks 10 and the lower planks 20 are not coplanar, the area of overlap between each upper plank and its two nearest neighbor adjacent lower planks is freely adjustable. Since the upper and lower planks do not align on the same plane, no trimming of the margin edge planks is required for fitting the vertical boundaries of the backsplash. Because the space between the countertop and kitchen cabinets is typically standardized to approximately 18 inches, most tile planks will not require cutting but will pre-fit the vertical space. Alternatively, when the countertop and/or cabinets are simultaneously installed, the installer can adjust the heights to accommodate the manufactured length of the tile planks.

In addition, the lower and upper planks are made available in various dimensions. For covering backsplashes in the kitchen, a collection of the planks in standardized sizes to fit a predetermined lower boundary such as the upper surface of the countertop, and a predetermined upper boundary such as the base of wall cabinets or a ceiling, is provided as part of the tile system. An installer selects and purchases the lengths and widths necessary to custom fit a given backsplash space. The plank spacing is selected based on both dimensions and aesthetic appeal of a particular design as can be seen in the various FIGS. Further, since the upper and lower planks are installed on different levels, different decorative surfaces for the upper and lower planks may be selected for creating a particular aesthetic effect. For the decorative mural plank, a size of approximately 28 inches by 30 inches is manufactured; this plank can be installed at a break between upper cabinets such as behind a cook top/range or behind a sink.

FIGS. 4A-4D depict details of optional tile system configurations in cross-section. The tile system of the invention is assembled with adhesive elements 160. The adhesive is selected from caulk or construction adhesive, pressure sensitive adhesive tapes, or any other adhesive that can support the affixation of the tiles to a wall or to each other. Note that different adhesives can be used at different locations in the system, e.g., between a tile and the wall vs. between an upper tile and a lower tile, depending upon the materials of the tiles. Note that although sealing strips 120 are depicted in FIGS., it is emphasized that these strips are optional.

Figure 4B:
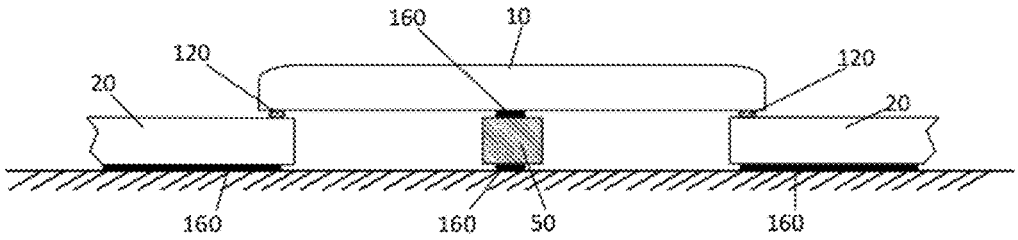
Figure 4C:
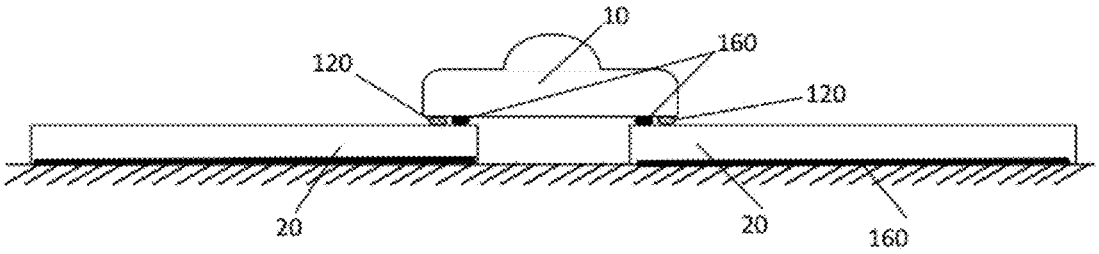
Figure 4D:
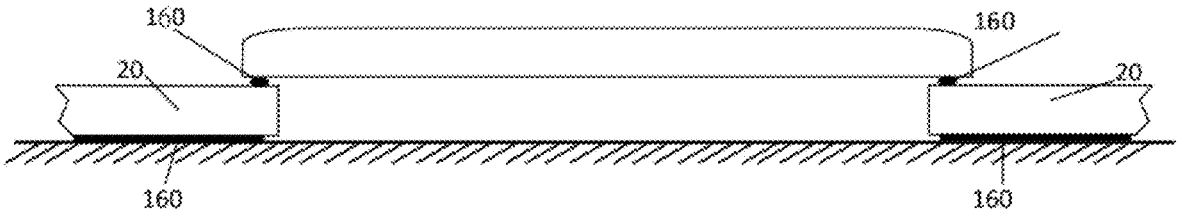

FIGS. 4C and 4D show a standard installation depicting locations of adhesive 160 relative to the upper and lower tile planks 10 and 20.

Figure 11A:
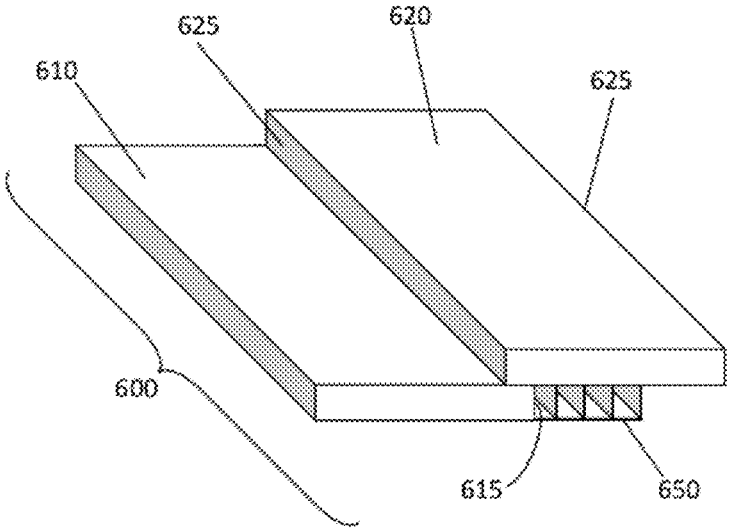
FIGS. 11A-11D depict various composite tiles.

FIGS. 4A and 4B show an optional installation technique. Depending upon the degree of overlap between the upper and lower planks and the selected plank material and thickness, an optional support member is positioned between the adjacent lower planks 10, as seen in the cross-sectional views of FIGS. 4A and 4B. In FIG. 4A support member 180 is a polymeric material which can be adhered in a strip between adjacent lower planks 20 and having approximately the same thickness as the lower planks. In an exemplary embodiment, support member 180 is an adhesive such as caulk or a suitable construction adhesive such as LIQUID NAILS®. When the support member 180 is an adhesive, the support member may be continuous or discontinuous, as with beads/spots of adhesive. In FIG. 4B, a support member 50, having approximately the same thickness as the lower planks 10, is positioned beneath upper plank 10. Optionally, upper tile plank 10 is integrally formed with support member 50 so that a composite tile plank is formed as seen in FIG. 11A. The support member 50 is selected from a low-cost, non-decorative material such as plastic blocks or HardiBacker® blocks. Because each support member 50 is fully concealed by a corresponding upper plank 10, no decorative surface finish is needed. Further, it is not necessary for the support plank to fill the entire space between adjacent lower planks 20. If support member 50 is separately applied, adhesive 160 is placed between the upper tile plank 10 and support member 50 and also between the wall and the support member.

Figure 5A:
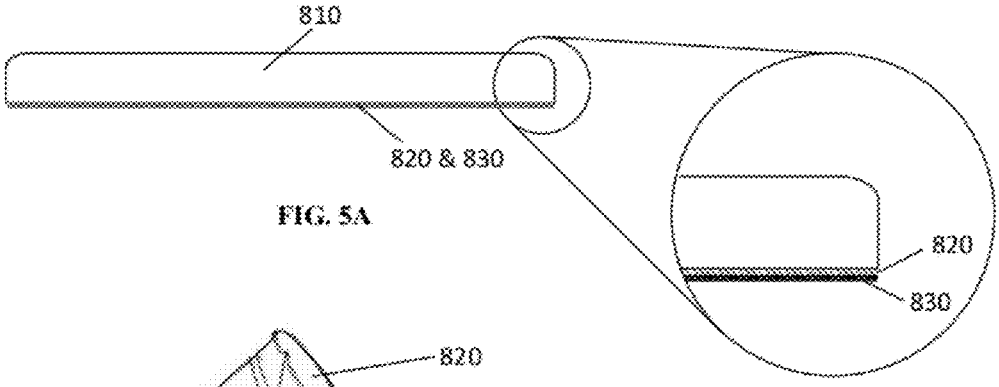
FIGS. 5A-5C depict optional tile plank support systems for upper tile planks
Figure 5B:
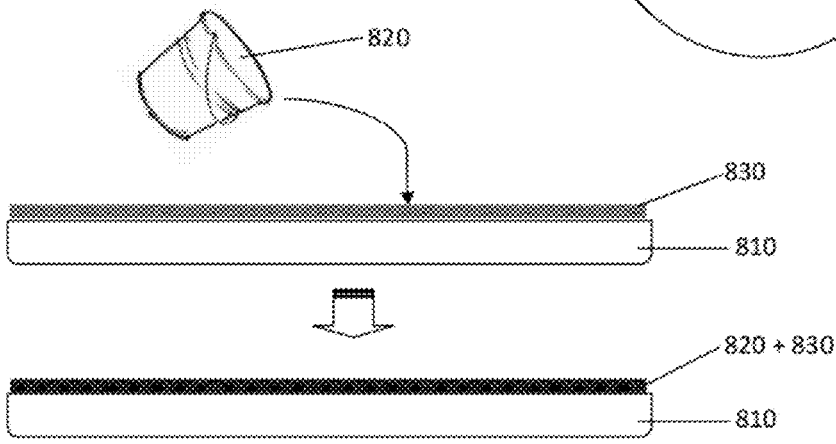
Figure 5C:
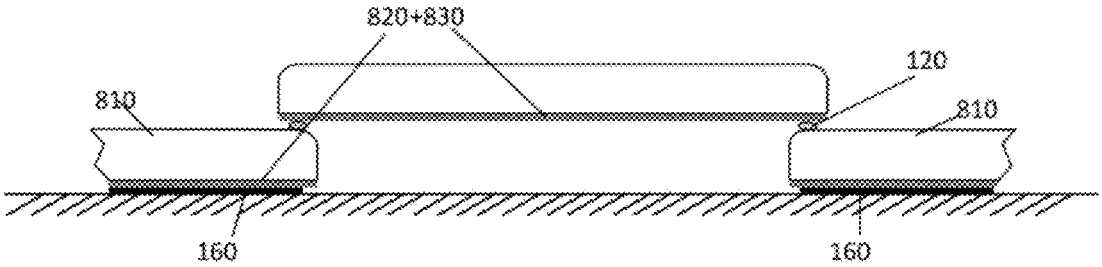

An alternative tile support system that can be used for upper and, optionally, lower tile planks is depicted in FIGS. 5A-5C. In FIG. 5A an upper tile plank 810 includes a support backing including glass fiber cloth 830 impregnated with a resin 820. Typically, the glass fiber cloth 830 is positioned on the underside of the upper tile plank 810 as seen in FIG. 5B (either as an individual tile or as a large tile blank prior to separation into individual tiles). Resin 820 impregnates all of glass fiber cloth 830 in FIG. 5B. When resin 820 solidifies, 820 and 830 together form a unified substrate "820+830" which is adhered to the underside of the upper tile plank 810 to provide optional support. Alternatively, the same process is used with a lower tile plank.

For installation of the reinforced tile planks, a backing member is not required as seen in FIG. 5C. Beads of glue 130 are deposited on the sides of the reinforced upper plank 810 on the surface of resin-impregnated glass cloth 820/830; the beads of glue 130 provide adhesion as well as a degree of water sealing to the system if water resistance is desired. Adhesive 160 is used to provide adhesion of lower tile planks 825 to the desired surface. In the embodiment of FIG. 5C lower tile planks 825 include the resin-impregnated fiberglass cloth; however this is optional depending on tile size, thickness, and material strength. Glue 120 can be selected from the same adhesive 160 discussed above. Although glass cloth is an exemplary reinforcement material, other cloths, scrims, and thin supports can be laminated to the tile planks to provide various levels of plank support.

Figure 11B:
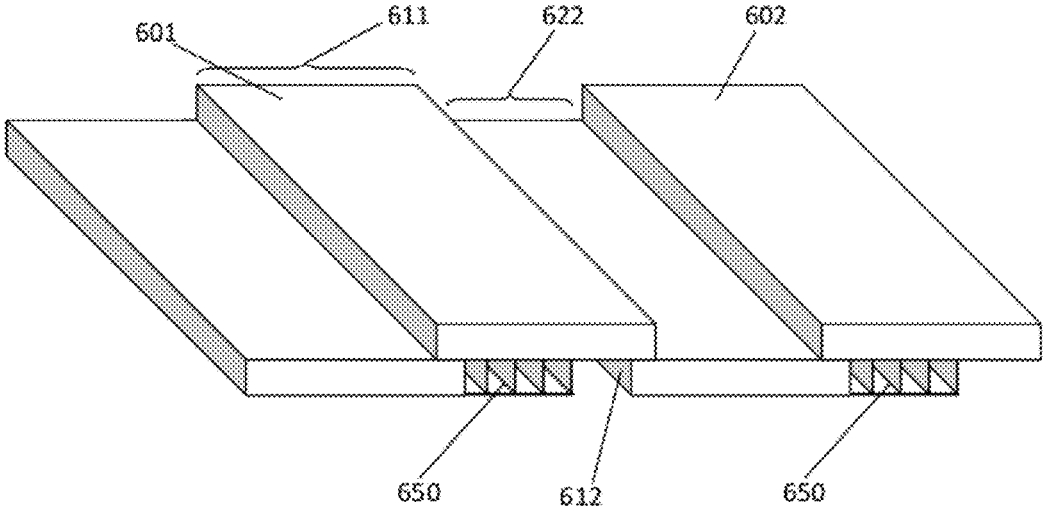
Figure 11C:
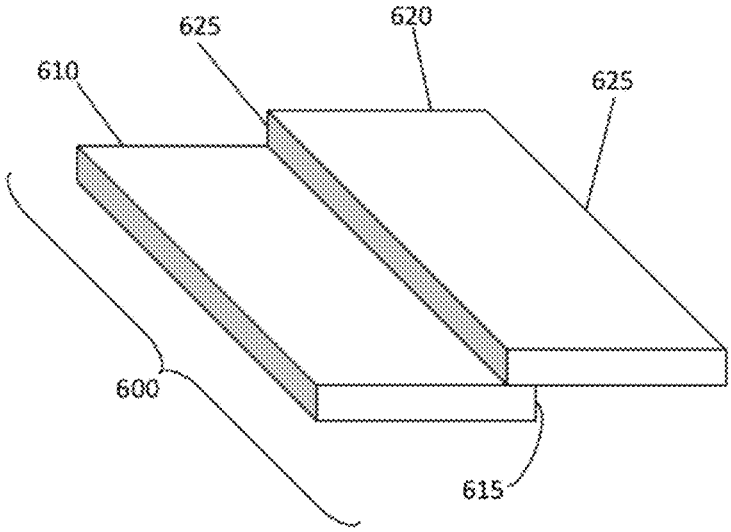
Figure 11D:
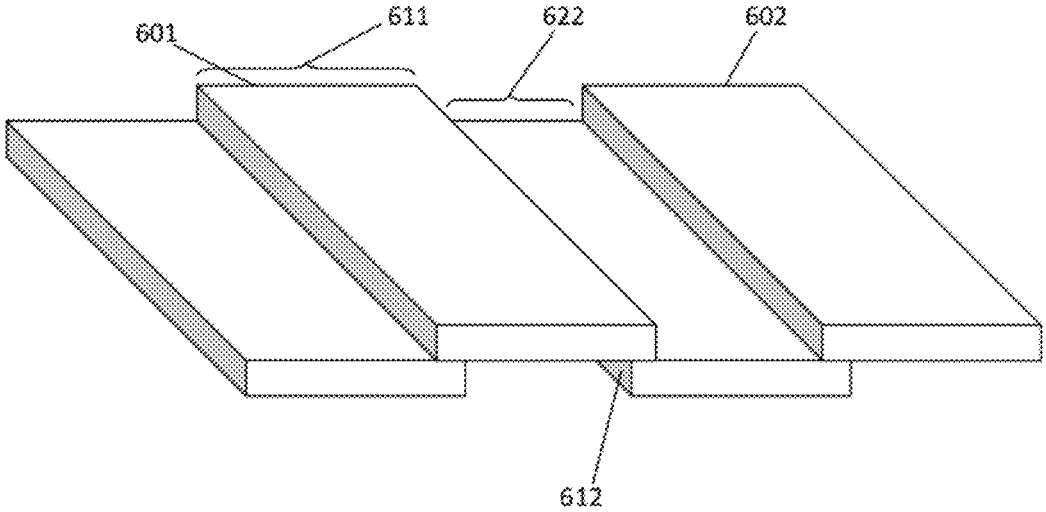
Figure 12A:
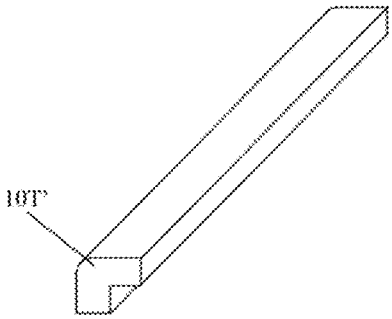
FIGS. 12A-12D depict upper tile planks with edge trim features.
Figure 12B:
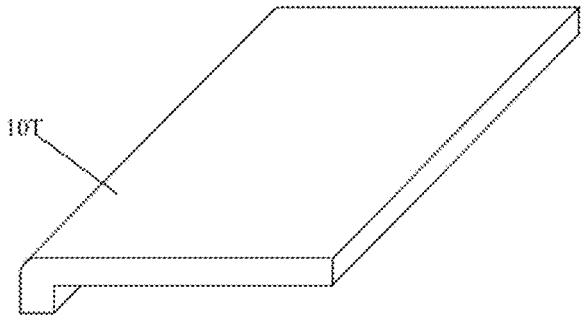
Figure 12C:
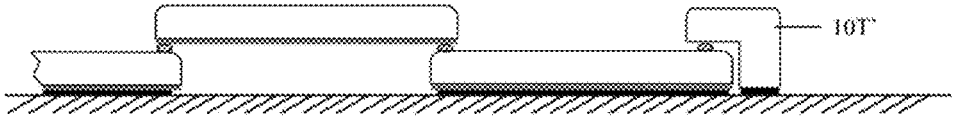
Figure 12D:
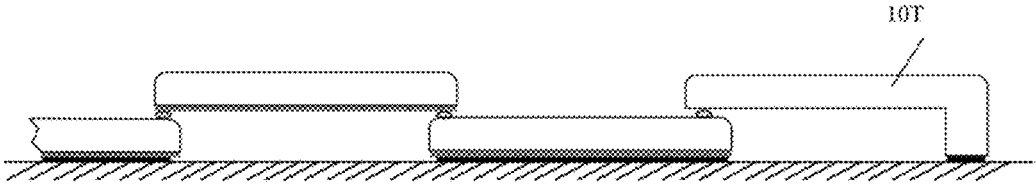

The upper and lower tile planks, with or without support planks or resin impregnated glass cloth backing, can be integrally formed as a composite upper/lower tile plank as depicted in FIGS. 11A-11D. In FIGS. 11A and 11C, upper and lower tile planks are joined prior to installation to form a composite tile plank 600. FIG. 11D depicts a set of composite tiles installed, as described below.

An alternative embodiment of the composite tile with an optional integrated support member is shown in FIGS. 11A-11D In FIG. 11A, the composite tile plank 600 comprises an upper plank member 620 and an optional support plank member 650 integrated therewith. The upper plank member 620 has a decorative surface finish on its upper surface and along vertical edges 625. Optionally, composite tile plank 600 further integrates a lower plank member 610 (FIG. 11A). Integrated lower plank member 610 also has a decorative surface finish on its upper surface, but does not require a decorative surface on its vertical edge 615 because it will be covered by an adjacent upper plank member. The upper and lower plank members can be integrated by adhesion, mechanical fasteners, integral formation, or any other joining technique or integral forming technique. Alternatively, a composite tile plank can be formed including upper plank member 620 and lower plank member 610 without support plank 650 as seen in FIG. 11C.

As shown in FIG. 11B, to install the composite tile planks, install a first composite tile plank 602 in vertical direction of the wall. Afterwards, affix second composite plank 601 such that upper tile plank portion 611 covers the lower tile plank member 622 of composite tile plank 602 such that the first composite tile plank 601 and the second composite tile plank 602 are aligned edgewise from each other in horizontal direction of the wall. As a result, vertical edge 612 of the lower plank member 622 of second composite tile plank 602 is covered by the upper plank member 611 of composite tile plank 601. As with the installation procedure described above, adhesive is used to affix the tiles to a wall or other vertical surface. Although not shown, optional sealing strips can be formed on the composite tile plank, similar to those described above. The installation of FIG. 11D is similarly installed.

Depending on the selected widths of the upper and lower tile planks, very few tile planks may be needed to cover a backsplash area. For example, if the three-dimensional upper tiles of FIG. 2C are selected in a narrow width combined with wide lower tile planks (for example, on the order of 18 to 30 inches wide), a typical backsplash can be formed using as few as three base panels, thus vastly simplifying and speeding up the installation process.

A further modification of upper tile planks 10 is depicted in FIGS. 12A-12D for edge tiles. Upper tiles 10T and 10T' include integrated edge trim portions that provide a more aesthetically-pleasing finished edge. Advantageously, when a high tile is the furthest tile along a backsplash installation, the integrated edge feature provides a finishing feature on the side which is not covering a low tile as well as providing a smooth, finished edge with no gap between an upper tile plank and the wall. As seen from tiles 10T and 10T', the tiles with integrated edge trim portions can be fabricated in a range of widths from a full-sized upper tile plank 10T to a narrow edge trim element 10T'. These tiles can also include reinforced backing members as discussed above with respect to FIG. 5. The tiles can be cut to form the shapes shown in FIGS. 12A-12D, particularly when the material is marble or stone. For cast materials (e.g., so-called "cultured" marble) the material can optionally be molded to form the integral edge feature.

While the foregoing invention has been described in terms of the above exemplary embodiments, it is understood that various modifications and variations are possible. Accordingly, such modifications and variations are within the scope of the invention as set forth in the following claims.

What is claimed is:

1. An easily-installed groutless tile plank backsplash system for covering a wall, said system comprising:

a plurality of lower tile planks selected from at least a first monolithic, rigid material comprising natural stone, marble, granite, porcelain, artificial stone, concrete, ceramic, or slumped glass, and having a first decorative surface finish and a first lower tile plank thickness, each lower plank configured to be positioned edgewise from each other in a horizontal direction of the wall in a first, lower plane substantially parallel to the wall such that adjacent lower planks are configured to be spaced apart from one another and the lower planks are manufactured to have a first predetermined length extending vertically between selected predetermined upper and lower boundaries of the wall and one or more first predetermined widths;

a plurality of upper tile planks selected from at least a second monolithic, rigid material, which is the same or different from the first material, the second material comprising natural stone, marble, granite, porcelain, artificial stone, concrete, ceramic, or slumped glass and having a second decorative surface finish and a decorative vertical edge finish on one or more exposed vertical edges, each upper plank configured to be positioned edgewise from each other in the horizontal direction of the wall in a second, upper plane substantially parallel to the wall such that adjacent upper planks are configured to be spaced apart from one another, the upper planks being manufactured to have a predetermined length and extending vertically between the predetermined upper and lower boundaries of the wall and having one or more second predetermined widths, the one or more second predetermined widths being the same as or different from the first one or more predetermined widths;

wherein the first thickness of the lower planks is the same or different from the second thickness of the upper planks and wherein the first decorative finish is the same or different from the second decorative finish;

the lower and upper planks being configured such that at least facing inner edges of two nearest neighbor adjacent lower planks in the lower plane are covered by a single upper plank positioned over the inner edges of the adjacent lower planks in the upper plane and wherein each of the upper planks and each of the lower planks is secured in position by an adhesive material; and wherein the spacing between adjacent upper planks and adjacent lower planks is adjustable to cover an intended width of a wall space without edge trimming and the spacing between upper planks is the same or different from the spacing between lower planks, the combination of the upper planks and lower planks adhesively affixed to a wall forming a water resistant backsplash without the need for mechanical fasteners and wherein the adhesive material directly adheres the upper plank to the wall.

2. A groutless tile plank backsplash system according to claim 1 wherein a lower tile plank is integrated with an upper tile plank to form a composite lower-upper tile plank.

3. A groutless tile plank backsplash system according to claim 2 wherein the composite lower-upper tile plank comprises a lower tile plank and an upper tile plank fabricated from the same material.

4. A groutless tile plank backsplash system according to claim 2 wherein the composite lower-upper tile plank comprises a lower tile plank and an upper tile plank each fabricated from different materials.

5. A groutless tile plank backsplash system according to claim 1 further comprising a support member positioned between adjacent lower tile planks for supporting an upper tile plank.

6. A groutless tile plank backsplash system according to claim 5 wherein the support member is integrated with the upper tile plank.

7. A groutless tile plank backsplash system according to claim 5 wherein the support member is a support plank.

8. A groutless tile plank backsplash system according to claim 5 wherein the support member is a polymeric material.

9. A groutless tile plank backsplash system according to claim 8 wherein the polymeric material is an adhesive.

10. A groutless tile plank backsplash system according to claim 1 wherein the upper tile plank has a three-dimensional decorative surface.

11. A groutless tile plank backsplash system according to claim 1 wherein at least one lower tile plank is a mural tile plank having a horizontal width substantially larger than other lower tile planks in the tile plank system, wherein the mural tile edges that are overlapped by upper tiles have the same thickness as other lower tile planks and other portions of the mural tile plank have a thickness that can be the same or different as the other lower tile planks.

12. An easily-installed groutless tile plank backsplash system including one or more decorative murals for covering a wall, said system comprising:

a plurality of lower tile planks selected from at least a first monolithic, rigid material comprising natural stone, marble, granite, porcelain, artificial stone, concrete, ceramic, or slumped glass and having a first decorative surface finish and a first lower tile plank thickness, each lower plank configured to be positioned edgewise from each other in a horizontal direction of the wall in a first, lower plane substantially parallel to the wall such that adjacent lower planks are configured to be spaced apart from one another and the lower planks are manufactured to have a first predetermined length extending vertically between selected predetermined upper and lower boundaries of the wall and one or more first predetermined widths, at least one of the lower planks configured to be a mural tile plank having a width substantially greater than the width of other lower planks in the backsplash system, the mural tile plank having a decorative feature incorporated therein;

a plurality of upper tile planks selected from at least a second monolithic, rigid material, which is the same or different from the first material, the second material comprising natural stone, marble, granite, porcelain, artificial stone, concrete, ceramic, or slumped glass and having a second decorative surface finish, each upper plank configured to be positioned edgewise from each other in the horizontal direction of the wall in a second, upper plane substantially parallel to the wall such that adjacent upper planks are configured to be spaced apart from one another, the upper planks being manufactured to have a predetermined length and extending vertically between the predetermined upper and lower boundaries of the wall and having one or more second predetermined widths, the one or more second predetermined widths being the same as or different from the first one or more predetermined widths;

wherein the first thickness of the lower planks is the same or different from the second thickness of the upper planks and wherein the first decorative finish is the same or different from the second decorative finish;

the lower and upper planks being configured such that at least facing inner edges of two nearest neighbor adjacent lower planks in the lower plane are covered by a single upper plank positioned over the inner edges of the adjacent lower planks in the upper plane and wherein each of the upper planks and each of the lower planks is secured in position by an adhesive material and wherein the adhesive material directly adheres the upper plank to the wall; and wherein the spacing between adjacent upper planks and adjacent lower planks is adjustable to cover an intended width of a wall space without edge trimming and the spacing between upper planks is the same or different from the spacing between lower planks, the combination of the upper planks and lower planks adhesively affixed to a wall forming a water resistant backsplash.

13. A groutless tile plank backsplash system according to claim 12 wherein the mural tile plank is a composite mural tile plank including a reinforcing backing member.

14. A groutless tile plank backsplash system according to claim 12 wherein upper tile planks overlapping the mural tile plank include one or more upper tile planks have a three-dimensional decorative surface.

15. A groutless tile plank backsplash system according to claim 12 wherein the mural tile plank has a pattern including inlay materials.

16. A groutless tile plank backsplash system according to claim 12 wherein the mural tile plank includes a three-dimensional decorative surface feature incorporated therein.

17. A groutless tile plank backsplash system according to claim 16 wherein the three-dimensional decorative surface feature incorporated therein includes a relief feature.

18. A groutless tile plank backsplash system according to claim 16 wherein the three-dimensional decorative surface feature incorporated therein includes a mosaic.

19. A groutless tile plank backsplash system according to claim 12 wherein at least one upper tile plank includes a finished edge trim feature.

* * * * *